US009828785B2

(12) United States Patent
Heffernan

(10) Patent No.: US 9,828,785 B2
(45) Date of Patent: Nov. 28, 2017

(54) POOL CLEANER

(71) Applicant: Glen Heffernan, Reseda, CA (US)

(72) Inventor: Glen Heffernan, Reseda, CA (US)

( * ) Notice: Subject to any disclaimer, the term of this patent is extended or adjusted under 35 U.S.C. 154(b) by 0 days.

(21) Appl. No.: 14/660,330

(22) Filed: Mar. 17, 2015

(65) Prior Publication Data

US 2016/0273237 A1 Sep. 22, 2016

(51) Int. Cl.
*E04H 4/16* (2006.01)

(52) U.S. Cl.
CPC ..... *E04H 4/1618* (2013.01)

(58) Field of Classification Search
CPC ..... E04H 4/1636
USPC ..... 210/167.16, 167.17, 238; 15/1.7
See application file for complete search history.

(56) References Cited

U.S. PATENT DOCUMENTS 5,226,205 A * 7/1993 Pearce ..... E04H 4/1654 15/1.7
5,787,538 A * 8/1998 Moore ..... E04H 4/1663 134/21
6,502,269 B1 * 1/2003 Balchan ..... E04H 4/1636 15/1.7
2006/0265820 A1 * 11/2006 Erlich ..... E04H 4/1636 15/1.7
2015/0128361 A1 * 5/2015 Erlich ..... E04H 4/1636 15/1.7
2015/0337555 A1 * 11/2015 Hui ..... E04H 4/1636 15/1.7

* cited by examiner

*Primary Examiner* — Fred Prince
(74) *Attorney, Agent, or Firm* — James A. Italia; Italia IP

(57) ABSTRACT

A mobile filter for removing solid contaminants from water such as swimming pools. The mobile filter has a handle maneuvered chassis, a powered propeller housed in a tubular body, which propeller propels water through a removable bag mesh filter installable on the tubular body. A submersible battery pack is slidably coupled to the handle, and is readily removable therefrom. The submersible battery pack has a cord terminating in a submersible connector matingly compatible with a corresponding submersible connector accessible on the tubular body containing the propeller and its submersible electric motor.

19 Claims, 3 Drawing Sheets

POOL CLEANER

FIELD OF THE DISCLOSURE

The present disclosure relates to manually maneuvered, wheeled, powered mobile filters for swimming pools and the like.

BACKGROUND

Swimming pools and other water filled structures periodically collect contaminants. In the case of structures open to the atmosphere, particularly outdoors, leaves and trash may settle on the water. Operators of water filled structures must periodically remove such contaminants.

Mobile filters have been proposed for this task. However, most mobile filters are encumbered with objectionable electrical or vacuum connections, and are hard to maneuver manually. There remains a need for improved mobile filters.

SUMMARY

The disclosed concepts address the above stated situation by providing a mobile filter which is powered, readily maneuvered, and free from the above noted encumbrances. To this end, there is disclosed a mobile filter having a wheeled chassis, a powered propeller contained within a body, and a removable bag mesh filter installable on the body. Notably, the propeller is powered by a submersible electric motor. A submersible battery pack is slidably coupled to a handle of the mobile filter. The submersible battery pack has a cord terminating in a submersible connector matingly compatible with a corresponding submersible connector accessible on the body containing the propeller and submersible electric motor.

Locating the submersible battery pack on the handle mitigates objectionable weight of the submersible battery pack, which might otherwise interfere with maneuverability. In addition, the submersible battery pack is designed to work with various sized batteries thereby allowing a user to change the battery pack design and still use the existing mobile filter having a wheeled chassis via the corresponding submersible connector head or an IP68 underwater connector. The batter pack may be adapted to slide along the handle, so that the submersible battery pack is easy to install and remove. This is an advantage when the submersible battery pack is depleted, and must be replaced with a different submersible battery pack, or removed for recharging. The submersible connectors obviously contribute to ease of installation and removal of the submersible battery pack.

It is an object to provide improved elements and arrangements thereof by apparatus for the purposes described which is inexpensive, dependable, and fully effective in accomplishing its intended purposes.

These and other objects will become readily apparent upon further review of the following specification and drawings.

BRIEF DESCRIPTION OF THE DRAWINGS

Various objects, features, and attendant advantages of the disclosed concepts will become more fully appreciated as the same becomes better understood when considered in conjunction with the accompanying drawings, in which like reference characters designate the same or similar parts throughout the several views, and wherein.

DETAILED DESCRIPTION

Figure 1:
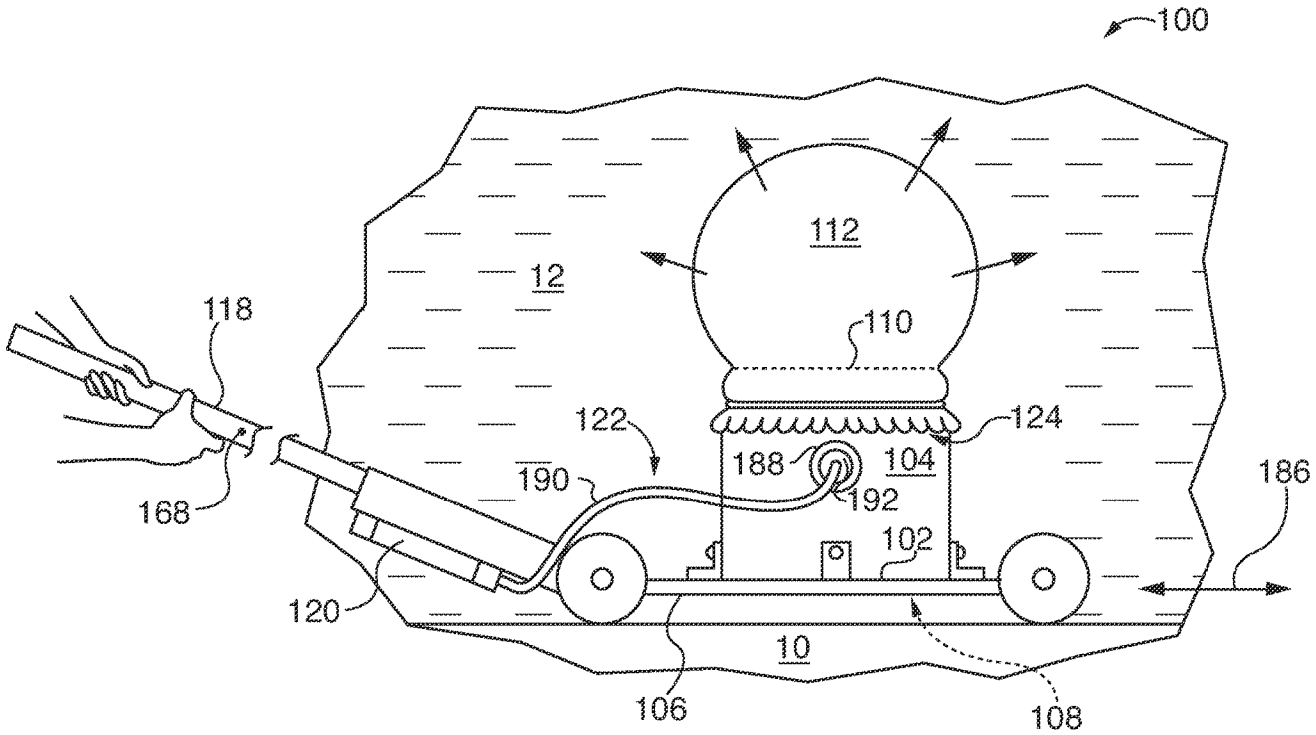
FIG. 1 is a diagrammatic environmental side view of a mobile powered filtering appliance, according to at least one aspect of the disclosure.
Figure 3:
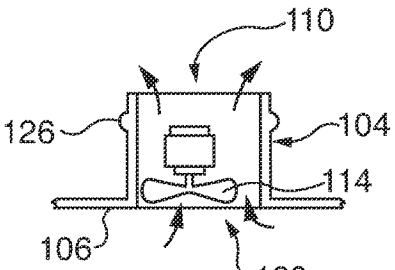
FIG. 3 is a cross sectional side detail view of the lower portion of FIG. 1.
Figure 2:
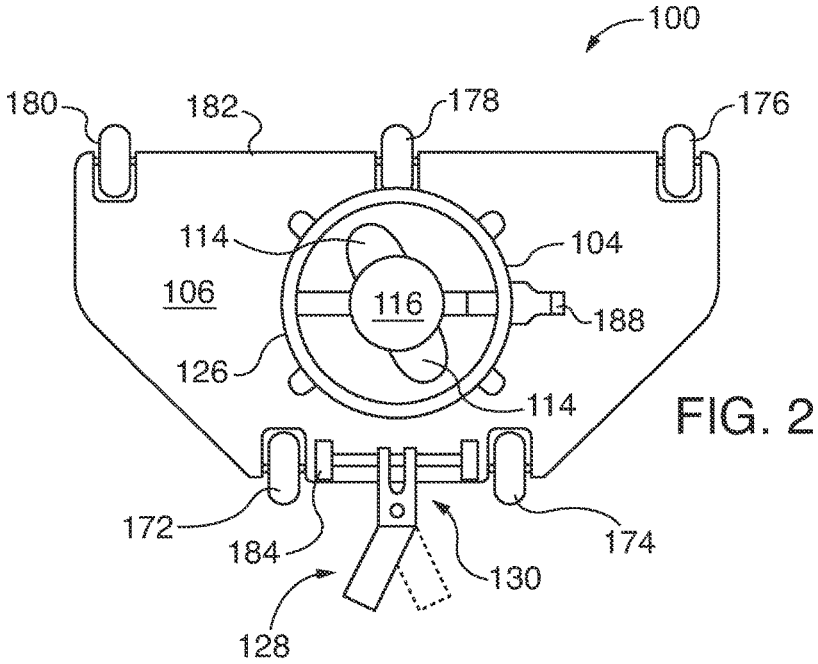
FIG. 2 is a diagrammatic top view of the appliance of FIG. 1, with a bag filter shown in FIG. 1 omitted in FIG. 2.

Referring first to FIGS. 1 and 2, according to at least one aspect of the disclosure, there is shown a mobile powered filtering appliance 100 for filtering solid objects (not shown) from a structure 10 containing water. Mobile powered filtering appliance 100 comprises a chassis 102 including a tubular body 104 fixed thereto. Referring also to FIG. 3, tubular body 104 is open to the underside 106 of chassis 102 at a first end 108 and to water 12 surrounding chassis 102 at a second end 110 when chassis 102 is fully immersed in water 12. A filter 112 is attachable to second end 110 of tubular body 104. A propeller 114 is mounted within tubular body 104. Propeller 114 is adapted to draw water 12 from first end 108 of tubular body 104 and to discharge water 12 from second end 110 of tubular body 104. A submersible electric motor 116 is drivingly connected to propeller 114.

An elongated handle 118 is coupled to chassis 102. A submersible battery pack 120 is mountable to elongated handle 118. An electrical conductor assembly 122 electrically connects submersible battery pack 120 to submersible electric motor 116.

Mounting of submersible battery pack 120 to elongated handle 118 minimizes burden of maneuvering mobile powered filtering appliance 100.

Submersible battery pack 120 may be a lithium ion type. Lithium ion batteries minimize the weight contribution of submersible battery pack 120, thereby helping to minimize effort of maneuvering mobile powered filtering appliance 100. Submersible battery pack may have a nominal voltage rating between 12 and 20 volts. Voltages in this range contribute to inherently safe usage characteristics while still providing sufficient power capacity to avoid requiring frequent battery recharging or replacement.

Figure 4:
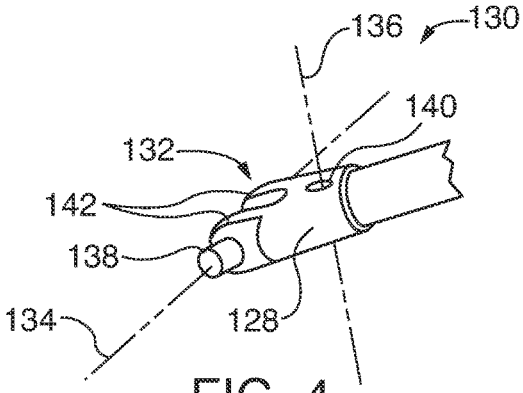
FIG. 4 is a perspective detail view of a mechanical connection usable with the appliance of FIG. 1.

Elongated handle 118 may be removably coupled to chassis 102 at a socket 128 (FIG. 2) which may be permanently mounted to chassis 102. In the absence of socket 128, elongated handle 118 may be directly coupled to chassis 102, or as illustrated, may engage socket 128. In the latter case, socket 128 engages chassis 102. Mobile powered filtering appliance 100 may comprise a flex joint 130 connecting elongated handle 118 to chassis 106. Flex joint 130 may comprise a universal joint 132 (FIGS. 2 and 4). As seen in FIG. 4, universal joint 132 comprises two perpendicular pivot axes 134, 136 provided by axles 138, 140 supported in a yoke 142 or the tubular portion of socket 138, respectively (FIG. 4).

Figure 5:
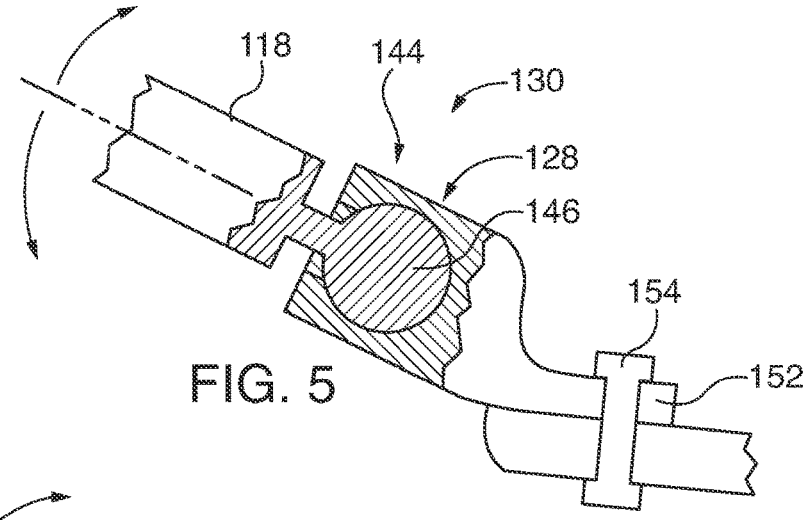
FIG. 5 is a side detail view of an alternative to the mechanical connection of FIG. 4, shown partly in cross section.

As an alternative to a universal joint, and referring to FIG. 5, flex joint 130 may comprise a ball and socket assembly 144. Elongated handle 118 may be coupled to ball 146 by a suitable detent device, such as a threaded coupling (not shown), a bayonet connection (not shown), a through pin such as through pin 148 of FIG. 6, or a deflectable, spring mounted interference finger such as spring mounted interference finger 150 of FIG. 7, which will be further described hereinafter. Other types of detent devices (none shown) may be provided if desired. In FIG. 5, socket 128 is coupled to chassis 102 by a tang 152, which tang 152 may be secured by a fastener such as a nut and bolt combination 154.

Figure 6:
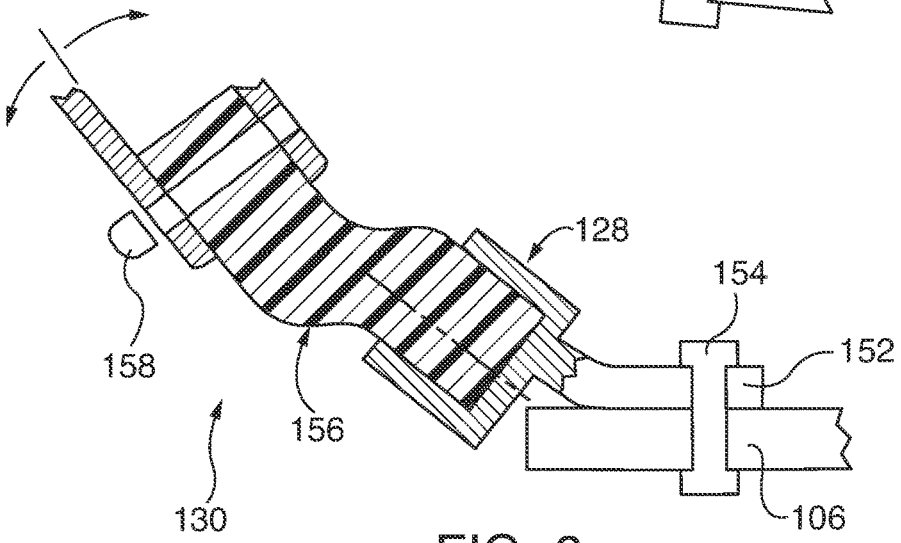
FIG. 6 is a side detail view of still another alternative to the mechanical connection of FIG. 4, shown partly in cross section.

Referring specifically to FIG. 6, flex joint 130 comprises a flexible link 156 spanning and connecting chassis 102 and elongated handle 118. Flexible link 156 may comprise any flexible material, such as stranded metallic or polymeric cable, flexible rubber or plastic, or a chain (not shown), among others. In the example of FIG. 6, flexible link 156 may be secured to either or both of elongated handle 118 and socket 128 by a through pin (i.e., nut and bolt combination 158, 160), by crimping, or in any other suitable way. In FIG. 6, socket 128 is coupled to chassis 102 by tang 152 by nut and bolt combination 154.

As a further alternative, elongated handle 118 may engage socket 128 by friction fit (not shown).

In FIGS. 1, 2, 3, 5, and 6, chassis 102 is depicted as a planar platform, but may of course take other forms, such as for example a skeleton (not shown) having openings which would be visible for example in the top view of FIG. 2.

Tubular body 104 is depicted as being cylindrical herein. However, tubular body could if desired take on other configurations, internally, externally, or both.

Structure 10 may be a swimming pool (only the floor portion is shown in FIG. 1). Propeller 114 is arranged to propel water 12 upwardly, as shown in FIG. 1, so that water 12 enters filter 112.

It should be noted at this point that orientational terms such as "upwardly" refer to the subject drawing as viewed by an observer. The drawing figures depict their subject matter in orientations of normal use, which could obviously change with changes in appliance position. Therefore, orientational terms must be understood to provide semantic basis for purposes of description only, and do not imply that their subject matter can be used only in one position.

The above is not to imply that mobile powered filtering appliance 100 can only be used with chassis 102 horizontally oriented. It would be possible to operate at an incline relative to the orientation shown in FIG. 1, particularly since thrust arising from propeller 114 will tend to urge mobile powered filtering appliance 100 in the opposite direction of discharge of water 12 from tubular body 104.

Figure 9:
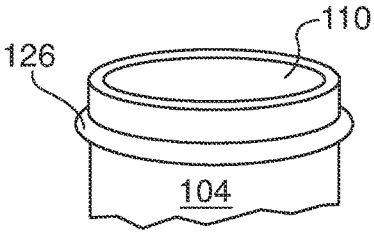
FIG. 9 is a perspective detail view of the center of FIG. 1, with a bag type filter omitted to reveal detail.

Filter 112 is a bag type filter having an opening 124 capable of closing over tubular body 104. Tubular body 104 may comprise an outward projection 126 about a circumference of tubular body 104. The bag type filter may be retained on tubular body 104 by tightening opening 124 of the bag type filter on tubular body 104 between outward projection 126 and chassis 102. The bag type filter may include a drawstring about the neck of the bag. When constricted by the drawstring, the neck of the bag will be prevented from sliding off tubular body 104 by interference with outward projection 126. Outward projection 126 is depicted herein as extending along the entire circumference of tubular body 104 (see FIG. 9). However, it will be recognized that outward projection 126 may be discontinuous, for example, comprising two or more separated sections or individual outward projections (this option is not shown).

Figure 7:
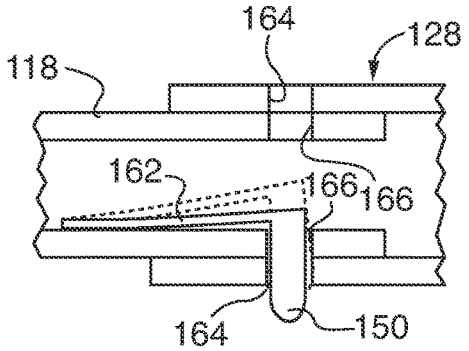
FIG. 7 is a side cross sectional detail view of a manual detent which may be incorporated into the structure shown in, for example, FIGS. 5 and 6.

Elongated handle 118 may be manually removable from chassis 102. Manually removable signified that no tools need be provided to release elongated handle 118 from engagement with socket 128 or alternatively from direct engagement with chassis 106. FIG. 7 illustrated an arrangement wherein elongated handle 118 is manually removable from socket 128. Interference finger 150 is fixed to a deflectable spring arm 162 fixed to the interior of elongated handle 118. When holes 164 passing through elongated handle 118 are axially aligned with holes 166 passing through socket 128, interference finger 150 occupies two holes 164, 166 to establish interference preventing elongated handle 118 from disengaging from socket 128. Spring arm 162 is arranged to bias interference finger 150 into the interference position shown in solid lines. Spring characteristics of spring arm 162 are such that finger pressure is sufficient to move interference finger 150 out of the interference position, as indicated by dashed lines.

Manual removal of elongated handle 118 enables submersible battery pack 120 to be readily replaced.

Referring specifically to FIG. 1, submersible battery pack 120 is mounted to elongated handle 118. Submersible battery pack 120 is located between the geometric center point 168 of elongated handle 118 and chassis 102 when submersible battery pack 120 is mounted to elongated handle 118. This location minimizes adverse effects of the mass of submersible battery pack 120 on maneuverability of mobile powered filtering appliance 100.

Figure 8:
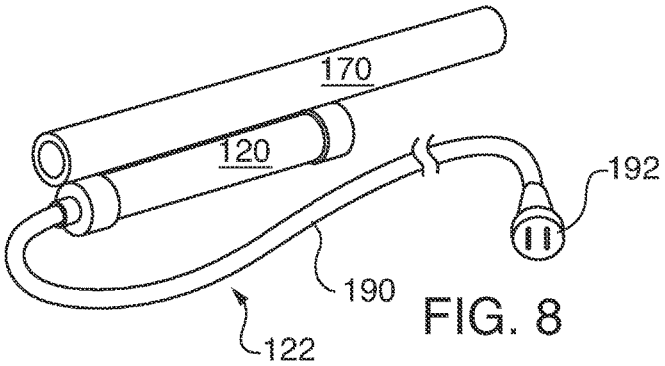
FIG. 8 is a perspective detail view of a battery shown at the lower left of FIG. 1.

Referring to FIGS. 1 and 8, submersible battery pack 120 further comprises a yoke which slidably engages elongated handle 118, whereby submersible battery pack 120 is slidably mountable to elongated handle 118. The yoke may take the form of a sleeve 170 which can be slipped over elongated handle 118.

Slidable engagement of elongated handle 118 expedites removal and installation of submersible battery pack 120. It is to be appreciated that the submersible battery pack 120 is adaptable to operate with various sized batteries. It is to be further appreciated that the submersible battery pack 120 can be retrofitted with different submersible battery pack designs (not shown). Moreover, in a preferred embodiment, the mobile powered filtering appliance 100 is further adapted to cooperate with various battery pack designs by utilizing the submersible electrical connector 188.

Referring to FIG. 2, mobile powered filtering appliance 100 may comprise a plurality of wheels 172, 174, 176, 178, 180 rotatably mounted to chassis 102. Wheels 172, 174, 176, 178, 180 facilitate travel of mobile powered filtering appliance 100 along solid surfaces such as the floor of structure 10 (FIG. 1).

The plurality of wheels 172, 174, 176, 178, 180 may include a first wheel 176 and a second wheel 180, both located on a side 182 of chassis 102 opposite elongated handle 118. The plurality of wheels 172,174, 176, 178, 180 may be limited to first and second wheels 176, 180. Two wheels located as described above would provide maximal maneuverability if the number of wheels were limited to two wheels (i.e., first and second wheels 176, 180).

The plurality of wheels may be increased from two wheels (first and second wheels 176, 180). To this end, mobile powered filtering appliance 100 may comprise a third wheel 178 located on side 182 of chassis 118 bearing elongated handle 118. Provision of third wheel 178 further stabilizes chassis 102 as mobile powered filtering appliance 100 traverses structure 10 (FIG. 1).

The plurality of wheels may be increased from two wheels (first and second wheels 176, 180, or from three wheels (first, second, and third wheels 176, 178, 180). To this end, mobile powered filtering appliance 100 may further comprise a fourth wheel 172 and a fifth wheel 174 located on a side 184 of chassis 102 bearing elongated handle 118, wherein the track of the first and second wheels 176, 180 is greater than the track of the fourth and fifth wheels 172, 174. Track is the distance between first and second wheels 176, 180, or between fourth and fifth wheels 172, 174. Fourth and fifth wheels still further improve stability of chassis 102 as mobile powered filtering appliance 100 traverses structure 10 (FIG. 1).

Fourth and fifth wheels 172, 174 may be present in the absence of wheel 178. Unless otherwise indicated, the terms "first", "second", etc., are used herein merely as labels, and are not intended to impose ordinal, positional, or hierarchical requirements on the items to which these terms refer. Moreover, reference to, e.g., a "second" item does not either require or preclude the existence of, e.g., a "first" or lower-numbered item, and/or, e.g., a "third" or higher-numbered item.

As seen in FIG. 1, second end 110 of tubular body 104 is oriented to discharge water 12 upwardly relative to the direction of motion of chassis 102 along structure 10 containing water 12. Direction of motion is indicated by an arrow 186. Discharge of water 12 upwardly will prevent side thrusts which might influence the direction of motion in an unintended way.

It would also be possible to arrange second end 110 to be directed such that a degree of thrust assists mobile powered filtering appliance 100 to move in the direction of motion (this option is not shown).

Referring to FIGS. 1, 2 and 8, submersible electric motor 116 comprises a submersible electrical connector 188 electrically connected to submersible electric motor 116 and accessible from the exterior of tubular body 104. Electrical connector assembly 122 comprises a flexible power cord 190 permanently attached to submersible battery pack 120 and including a submersible terminal 192 configured to electrically connect submersible battery pack 120 to submersible electrical connector 122 of submersible electric motor 116. Flexible power cord 190 enables ready connection of submersible battery pack 120 to submersible electric motor 116 even though submersible battery pack 120 might be variably located along elongated handle 118 within a limited range. Submersible electrical connector 188 of submersible electric motor 116 and submersible terminal 192 of flexible power cord 190 meet IEC (International Electrotechnical Commission) standard IP68. Conformity to standard IP68 both assures reasonable protection of ingress of water to energized electrical components, and also enables use of established or conventional electrical connectors.

While the disclosed concepts have been described in connection with what is considered the most practical and preferred implementation, it is to be understood that the disclosed concepts are not to be limited to the disclosed arrangements, but are intended to cover various arrangements which are included within the spirit and scope of the broadest possible interpretation of the appended claims so as to encompass all modifications and equivalent arrangements which are possible.

It should be understood that the various examples of the apparatus(es) disclosed herein may include any of the components, features, and functionalities of any of the other examples of the apparatus(es) disclosed herein in any feasible combination, and all of such possibilities are intended to be within the spirit and scope of the present disclosure. Many modifications of examples set forth herein will come to mind to one skilled in the art to which the present disclosure pertains having the benefit of the teachings presented in the foregoing descriptions and the associated drawings.

Therefore, it is to be understood that the present disclosure is not to be limited to the specific examples presented and that modifications and other examples are intended to be included within the scope of the appended claims. Moreover, although the foregoing description and the associated drawings describe examples of the present disclosure in the context of certain illustrative combinations of elements and/or functions, it should be appreciated that different combinations of elements and/or functions may be provided by alternative implementations without departing from the scope of the appended claims.

I claim:

1. A mobile powered filtering appliance for filtering solid objects from a structure containing water, comprising:

a chassis including a tubular body fixed thereto, the tubular body open to the underside of the chassis at a first end and to water surrounding the chassis at a second end when the chassis is fully immersed in the water;

a filter attachable to the second end of the tubular body;

a propeller mounted within the tubular body, the propeller adapted to draw water from the first end of the tubular body and to discharge water from the second end of the tubular body;

a submersible electric motor drivingly connected to the propeller;

an elongated handle coupled to the chassis;

a submersible battery pack mounted to the elongated handle, such that the battery pack is located along the length of the handle; and an electrical conductor assembly electrically connecting the submersible battery pack to the submersible electric motor.

2. The mobile powered filtering appliance of claim 1, wherein the elongated handle is manually removable from the chassis.

3. The mobile powered filtering appliance of claim 1, wherein the submersible battery pack is mounted to the elongated handle, the submersible battery pack is located between the geometric center point of the elongated handle and the chassis when the submersible battery pack is mounted to the elongated handle.

4. The mobile powered filtering appliance of claim 1, wherein the submersible battery pack further comprises a yoke which slidably engages the elongated handle, whereby the submersible battery pack is slidably mountable to the elongated handle.

5. The mobile powered filtering appliance of claim 1, further comprising a flex joint connecting the elongated handle to the chassis.

6. The mobile powered filtering appliance of claim 5, wherein the flex joint comprises a universal joint.

7. The mobile powered filtering appliance of claim 5, wherein the flex joint comprises a ball and socket assembly.

8. The mobile powered filtering appliance of claim 5, wherein the flex joint comprises a flexible link spanning and connecting the chassis and the elongated handle.

9. The mobile powered filtering appliance of claim 1, further comprising a plurality of wheels rotatably mounted to the chassis.

10. The mobile powered filtering appliance of claim 9, wherein the plurality of wheels include a first wheel and a second wheel, both located on a side of the chassis opposite the elongated handle.

11. The mobile powered filtering appliance of claim 10, further comprising a third wheel located on a side of the chassis bearing the elongated handle.

12. The mobile powered filtering appliance of claim 11, further comprising a fourth wheel located on the side of the chassis bearing the elongated handle, wherein the track of the first and second wheels is greater than the track of the third and fourth wheels.

13. The mobile powered filtering appliance of claim 1, wherein the second end of the tubular body is oriented to discharge water perpendicularly relative to the direction of motion of the chassis along the structure containing water.

14. The mobile powered filtering appliance of claim 1, wherein the filter is a bag type filter having an opening capable of closing over the tubular body.

15. The mobile powered filtering appliance of claim 14, wherein the tubular body comprises an outward projection about a circumference of the tubular body, whereby the bag type filter may be retained on the tubular body by tightening the opening of the bag type filter on the tubular body between the outward projection and the chassis.

16. The mobile powered filtering appliance of claim 1, wherein the submersible battery pack is a lithium ion type.

17. The mobile powered filtering appliance of claim 16, wherein the submersible battery pack has a nominal voltage rating between 12 and 20 volts.

18. The mobile powered filtering appliance of claim 1, wherein the submersible electric motor comprises a submersible electrical connector electrically connected to the submersible electric motor and accessible from the exterior of the tubular body; and the electrical connector assembly comprises a flexible power cord permanently attached to the submersible battery pack and including a submersible terminal configured to electrically connect the submersible battery pack to the submersible electrical connector of the submersible electric motor.

19. The mobile powered filtering appliance of claim 18, wherein the submersible electrical connector of the submersible electric motor and the submersible terminal of the flexible power cord meet IEC standard IP68.

* * * * *